US007645359B2

(12) United States Patent
Lorenz et al.

(10) Patent No.: US 7,645,359 B2
(45) **Date of Patent: *Jan. 12, 2010**

(54) PROCESS FOR MAKING A FIBROUS STRUCTURE COMPRISING CELLULOSIC AND SYNTHETIC FIBERS

(75) Inventors: Timothy Jude Lorenz, Cincinnati, OH (US); Osman Polat, Montgomery, OH (US); Paul Dennis Trokhan, Hamilton, OH (US); Dean Phan, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 74 days.

This patent is subject to a terminal disclaimer.

(21) Appl. No.: 11/324,988

(22) Filed: Jan. 3, 2006

(65) Prior Publication Data

US 2006/0108047 A1 May 25, 2006

Related U.S. Application Data

(60) Division of application No. 10/740,059, filed on Dec. 18, 2003, now Pat. No. 7,045,026, which is a continuation-in-part of application No. 10/360,038, filed on Feb. 6, 2003, now Pat. No. 7,052,580, and a continuation-in-part of application No. 10/360,021, filed on Feb. 6, 2003, now Pat. No. 7,067,038.

(51) Int. Cl.
*D21H 13/10* (2006.01)
*D21H 27/02* (2006.01)

(52) U.S. Cl. ..... 162/146; 162/109; 162/117; 162/123; 162/116; 162/211; 162/157.1; 162/111; 156/62.2

(58) Field of Classification Search ..... 162/141, 162/146, 157.1–157.7, 109, 117, 123; 428/195, 428/156, 152–154, 172, 195.1; 442/51, 54, 442/361, 374, 381, 385, 389, 390, 409, 415, 442/109; 156/62.2; 264/113
See application file for complete search history.

(56) References Cited

U.S. PATENT DOCUMENTS 2,999,788 A * 9/1961 Morgan ..... 162/146

(Continued)

FOREIGN PATENT DOCUMENTS

EP 0 080 382 B1 8/1988

(Continued)

*Primary Examiner*—José A Fortuna
(74) *Attorney, Agent, or Firm*—C. Brant Cook

(57) ABSTRACT

A method for making a fibrous structure including a plurality of synthetic fibers disposed in a predetermined pattern and a plurality of cellulosic fibers generally randomly distributed throughout at least one layer of the fibrous structure. The method includes depositing an aqueous slurry including synthetic fibers and an aqueous slurry including cellulosic fibers onto a fluid-permeable forming member having a pattern of channels. The slurries are dewatered to form a fibrous web, wherein the at least some of the cellulosic fibers are randomly distributed throughout at least a portion of the fibrous web and a plurality of synthetic fibers are at least partially non-randomly distributed in the channels. A fluid pressure differential is applied to the fibrous web disposed on the forming member, thereby molding the fibrous web such that the fibrous web includes a first plurality of micro-regions corresponding to a plurality of fluid-permeable areas of the forming member and a second plurality of micro-regions corresponding to a plurality of fluid-impermeable areas of the forming member.

19 Claims, 5 Drawing Sheets

U.S. PATENT DOCUMENTS 3,034,180 A 5/1962 Greiner et al.
3,116,199 A * 12/1963 Cruz, Jr. et al. ..... 162/146
3,301,746 A 1/1967 Sanford et al.
3,473,576 A 10/1969 Amneus
3,573,164 A 3/1971 Friedberg et al.
3,812,000 A 5/1974 Salvucci, Jr. et al.
3,821,068 A 6/1974 Shaw
3,879,257 A 4/1975 Gentile et al.
3,947,315 A 3/1976 Smith
3,974,025 A 8/1976 Ayers
3,984,898 A 10/1976 Matsumura et al.
3,994,771 A 11/1976 Morgan, Jr. et al.
4,166,001 A 8/1979 Dunning et al.
4,191,609 A 3/1980 Trokhan
4,202,959 A 5/1980 Henbest et al.
4,208,459 A 6/1980 Becker et al.
4,239,065 A 12/1980 Trokhan
4,300,981 A 11/1981 Carstens
4,486,268 A 12/1984 Nuttall et al.
4,487,796 A 12/1984 Lloyd et al.
4,514,345 A * 4/1985 Johnson et al. ..... 264/425
4,528,239 A * 7/1985 Trokhan ..... 442/33
4,637,859 A 1/1987 Trokhan
4,741,941 A 5/1988 Englebert et al.
4,755,421 A 7/1988 Manning et al.
4,942,077 A 7/1990 Wendt et al.
5,094,717 A 3/1992 Manning et al.
5,102,501 A 4/1992 Eber et al.
5,178,729 A 1/1993 Janda
5,245,025 A 9/1993 Trokhan et al.
5,284,703 A 2/1994 Everhart et al.
5,389,202 A 2/1995 Everhart et al.
5,405,499 A 4/1995 Vinson
5,409,572 A 4/1995 Kershaw et al.
5,494,554 A 2/1996 Edwards et al.
5,516,580 A 5/1996 Frenette et al.
5,527,428 A 6/1996 Trokhan et al.
5,538,595 A 7/1996 Trokhan et al.
5,580,423 A 12/1996 Ampulski et al.
5,582,685 A 12/1996 Vinson
5,667,636 A 9/1997 Engel et al.
5,672,248 A 9/1997 Wendt et al.
5,804,036 A * 9/1998 Phan et al. ..... 162/116
5,888,347 A 3/1999 Engel et al.
5,906,710 A * 5/1999 Trokhan ..... 162/109
5,916,507 A 6/1999 Dabi et al.
5,935,880 A 8/1999 Wang et al.
5,961,757 A 10/1999 Trombetta et al.
5,989,682 A 11/1999 Anderson
5,990,377 A 11/1999 Chen et al.
6,017,417 A 1/2000 Wendt et al.
6,039,839 A * 3/2000 Trokhan et al. ..... 162/116
6,103,061 A 8/2000 Anderson et al.
6,110,324 A * 8/2000 Trokhan et al. ..... 162/358.2
6,110,848 A 8/2000 Bouchette
6,117,270 A * 9/2000 Trokhan ..... 162/109
6,129,815 A 10/2000 Larson et al.
6,171,447 B1 * 1/2001 Trokhan ..... 162/358.2
6,193,847 B1 * 2/2001 Trokhan ..... 162/358.1
6,207,012 B1 3/2001 Oriaran et al.
6,241,850 B1 6/2001 Kelly
6,277,241 B1 * 8/2001 Merker et al. ..... 162/111
6,328,850 B1 12/2001 Phan et al.
6,361,654 B1 3/2002 Chuang et al.
6,368,609 B1 4/2002 Fontenot et al.
6,451,099 B1 9/2002 Miyamoto et al.
6,534,151 B2 3/2003 Merker
6,576,091 B1 6/2003 Cabell et al.
6,752,905 B2 6/2004 Hu et al.
6,841,038 B2 1/2005 Horenziak et al.
6,849,156 B2 * 2/2005 Besemer et al. ..... 162/9
6,861,380 B2 3/2005 Garnier et al.
6,887,350 B2 5/2005 Garnier et al.
7,041,196 B2 * 5/2006 Lorenz et al. ..... 162/109
7,045,026 B2 * 5/2006 Lorenz et al. ..... 156/62.2
7,052,580 B2 5/2006 Trokhan et al.
7,067,038 B2 6/2006 Trokhan et al.
7,156,953 B2 * 1/2007 Tirimacco et al. ..... 162/112
7,354,502 B2 * 4/2008 Polat et al. ..... 162/146
2002/0112830 A1 8/2002 Bakken et al.
2002/0180092 A1 12/2002 Bednarz et al.
2004/0087237 A1 5/2004 Garnier et al.
2004/0112558 A1 6/2004 Garnier et al.
2004/0154763 A1 8/2004 Polat et al.
2004/0154767 A1 * 8/2004 Trokhan et al. ..... 162/146
2004/0154768 A1 * 8/2004 Trokhan et al. ..... 162/146
2004/0154769 A1 * 8/2004 Lorenz et al. ..... 162/146
2004/0157515 A1 * 8/2004 Lorenz et al. ..... 442/32
2004/0157524 A1 8/2004 Polat et al.
2006/0108046 A1 * 5/2006 Lorenz et al. ..... 156/62.2
2006/0108047 A1 * 5/2006 Lorenz et al. ..... 156/62.2
2006/0175030 A1 * 8/2006 Trokhan et al. ..... 162/146
2006/0180287 A1 * 8/2006 Trokhan et al. ..... 162/146
2007/0232180 A1 * 10/2007 Polat et al. ..... 442/414

FOREIGN PATENT DOCUMENTS

EP 0 616 074 A1 9/1994
EP 1 236 827 A1 9/2002
WO WO 93/14267 7/1993
WO WO 00/20675 4/2000
WO WO 00/39394 7/2000
WO WO 2004072372 A1 * 8/2004
WO WO 2004072373 A1 * 8/2004

* cited by examiner

PROCESS FOR MAKING A FIBROUS STRUCTURE COMPRISING CELLULOSIC AND SYNTHETIC FIBERS

CROSS REFERENCE TO RELATED APPLICATIONS

This application is a divisional application of U.S. application Ser. No. 10/740,059, filed Dec. 18, 2003, now U.S. Pat. No. 7,045,026, which is a continuation-in-part application of U.S. application Ser. No. 10/360,038, filed Feb. 6, 2003, now U.S. Pat. No. 7,052,580, and a continuation-in-part application of U.S. application Ser. No. 10/360,021, filed Feb. 6, 2003 now U.S. Pat. No. 7,067,038.

FIELD OF THE INVENTION

The present invention relates to methods for making fibrous structures comprising cellulose fibers and synthetic fibers in combination, and more specifically to fibrous structures having cellulose fibers distributed generally randomly and synthetic fibers distributed in a non-random pattern.

BACKGROUND OF THE INVENTION

Fibrous structures, such as paper webs, are well known in the art and are in common use today for paper towels, toilet tissue, facial tissue, napkins, wet wipes, and the like. Typical tissue paper is comprised predominantly of cellulosic fibers, often wood-based. Despite a broad range of cellulosic fiber types, such fibers are generally high in dry modulus and relatively large in diameter, which may cause their flexural rigidity to be higher than desired. Further, wood fibers can have a relatively high stiffness when dry, which may negatively affect the softness of the product and may have low stiffness when wet, which may cause poor absorbency of the resulting product.

To form a web, the fibers in typical disposable paper products are bonded to one another through chemical interaction and often the bonding is limited to the naturally occurring hydrogen bonding between hydroxyl groups on the cellulose molecules. If greater temporary or permanent wet strength is desired, strengthening additives can be used. These additives typically work by either covalently reacting with the cellulose or by forming protective molecular films around the existing hydrogen bonds. However, they can also produce relatively rigid and inelastic bonds, which may detrimentally affect softness and absorption properties of the products.

The use of synthetic fibers along with cellulose fibers can help overcome some of the previously mentioned limitations. Synthetic polymers can be formed into fibers with very small fiber diameters and are generally lower in modulus than cellulose. Thus, a fiber can be made with very low flexural rigidity, which facilitates good product softness. In addition, functional cross-sections of the synthetic fibers can be micro-engineered as desired. Synthetic fibers can also be designed to maintain modulus when wetted, and hence webs made with such fibers resist collapse during absorbency tasks. Accordingly, the use of thermally bonded synthetic fibers in tissue products can result in a strong network of highly flexible fibers (good for softness) joined with water-resistant high-stretch bonds (good for softness and wet strength). However, synthetic fibers can be relatively expensive as compared to cellulose fibers. Thus, it may be desired to include only as many synthetic fibers as are necessary to gain the desired benefits that the fibers provide.

Thus, it would be advantageous to provide improved fibrous structures including cellulosic and synthetic fibers in combination, and processes for making such fibrous structures. It would also be advantageous to provide a product that has synthetic fibers concentrated in certain desired portions of the resulting web and a method to allow for such non-random placement of such fibers.

SUMMARY OF THE INVENTION

To address the problems with respect to the prior art, certain methods are provided for making unitary fibrous structures including a plurality of synthetic fibers and a plurality of cellulosic fibers. The methods include providing a first aqueous slurry comprising a plurality of synthetic fibers and providing a second aqueous slurry comprising a plurality of cellulosic fibers. The methods also include depositing the first and second aqueous slurries onto a fluid-permeable forming member having a pattern of channels and partially dewatering the deposited first and second slurries to form a fibrous web comprising a plurality of cellulosic fibers randomly distributed throughout at least a portion of the fibrous web and a plurality of synthetic fibers at least partially non-randomly distributed in the channels. A fluid pressure differential is applied to the fibrous web disposed on the forming member, thereby molding the fibrous web according to the pattern of channels, wherein the fibrous web disposed on the forming member comprises a first plurality of micro-regions corresponding to a plurality of fluid-permeable areas of the forming member and a second plurality of micro-regions corresponding to a plurality of fluid-impermeable areas of the forming member. The methods also include forming a unitary fibrous structure in which at least some of the plurality of synthetic fibers are disposed in a predetermined pattern and the plurality of cellulosic fibers remain generally randomly distributed throughout at least one layer of the fibrous structure.

DETAILED DESCRIPTION OF THE INVENTION

Figure 1:
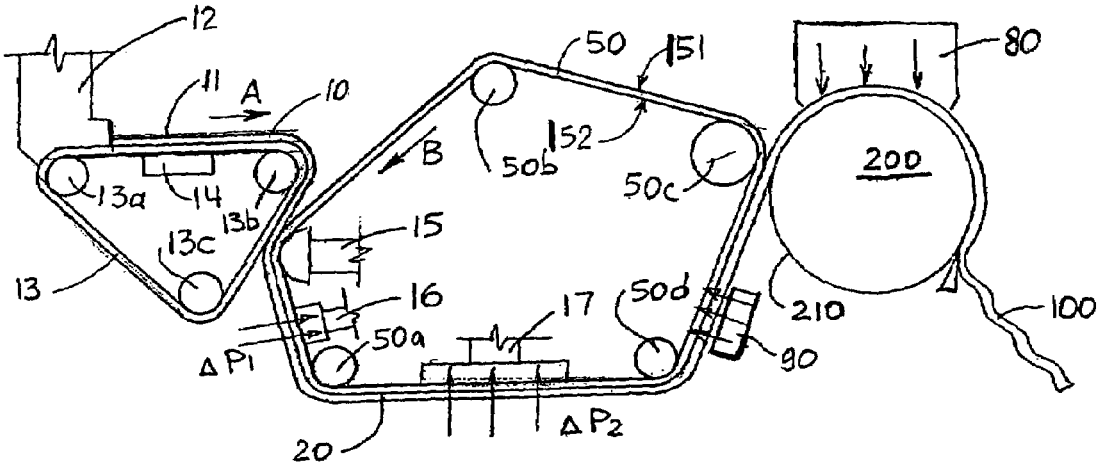
FIG. 1 is a schematic side view of an embodiment of the process of the present invention.

As used herein, the following terms have the following meanings.

"Unitary fibrous structure" is an arrangement comprising a plurality of cellulosic fibers and synthetic fibers that are inter-entangled or otherwise joined to form a sheet product having certain pre-determined microscopic geometric, physical, and aesthetic properties. The cellulosic and/or synthetic fibers may be layered or otherwise arranged in the unitary fibrous structure.

"Micro-geometry" or permutations thereof, refers to relatively small (i.e., "microscopical") details of the fibrous structure, such as, for example, surface texture, without regard to the structure's overall configuration, as opposed to its overall (i.e., "macroscopical") geometry. For example, in the molding member of the present invention, the fluid-permeable areas and the fluid-impermeable areas in combination comprise the micro-geometry of the molding member. Terms containing "macroscopical" or "macroscopically" refer to a "macro-geometry," or an overall geometry, of a structure or a portion thereof, under consideration when it is placed in a two-dimensional configuration, such as the X-Y plane. For example, on a macroscopical level, a fibrous structure, when disposed on a flat surface, comprises a flat sheet. On a microscopical level, however, the fibrous structure may comprise a plurality of micro-regions that form differential elevations, such as, for example, a network region having a first elevation, and a plurality of fibrous "pillows" dispersed throughout and outwardly extending from the framework region to form a second elevation.

"Basis weight" is the weight (measured in grams) of a unit area (typically measured in square meters) of the fibrous structure, which unit area is taken in the plane of the fibrous structure. The size and shape of the unit area from which the basis weight is measured is dependent upon the relative and absolute sizes and shapes of the regions having differential basis weights. Basis weight is measured as described in the test method section, below.

"Caliper" is the macroscopic thickness of a sample. Caliper should be distinguished from the elevation of differential regions, which is a microscopical characteristic of the regions. Most typically, a caliper is measured under a uniformly applied load of 95 grams per square centimeter ($g/cm^2$). Caliper is measured as described in the test method section, below.

"Density" is the ratio of the basis weight to a thickness (taken normal to the plane of the fibrous structure) of a region. Apparent density is the basis weight of the sample divided by the caliper with appropriate unit conversions incorporated therein. Apparent density used herein has the units of grams per cubic centimeter ($g/cm^3$).

"Machine direction" (or "MD") is the direction parallel to the flow of the fibrous structure being made through the manufacturing equipment. "Cross-machine direction" (or "CD") is the direction perpendicular to the machine direction.

"X," "Y," and "Z" designate a conventional system of Cartesian coordinates, wherein mutually perpendicular coordinates "X" and "Y" define a reference X-Y plane, and "Z" defines an orthogonal to the X-Y plane. When an element, such as, for example, a molding member curves or otherwise deplanes, the X-Y plane follows the configuration of the element.

"Substantially continuous" region (area/network/framework) refers to an area within which one can connect any two points by an uninterrupted line running entirely within that area throughout the line's length. That is, a substantially continuous region or pattern has a substantial "continuity" in all directions parallel to the X-Y plane and is terminated only at edges of that region. The term "substantially" in conjunction with "continuous" is intended to indicate that while an absolute continuity is contemplated, minor deviations from the absolute continuity may be tolerable as long as those deviations do not appreciably affect the performance of the fibrous structure or a molding member as designed and intended.

"Substantially semi-continuous" region (area/network/framework) refers to an area which may have "continuity" in all, but at least one, directions parallel to the X-Y plane, and in which area one cannot connect every set of two points by an uninterrupted line running entirely within that area throughout the line's length. Of course, minor deviations from such continuity may be tolerable as long as those deviations do not appreciably affect the performance of the structure or the molding member.

"Discontinuous" regions (or patterns) refer to discrete, and separated from one another areas that are discontinuous in all directions parallel to the X-Y plane.

"Redistribution" means at least some of the plurality of fibers comprised in the unitary fibrous structure of the present invention at least partially melt, move, shrink, and/or otherwise change their initial position, condition, and/or shape in the web.

"Co-joined fibers" means two or more fibers that have been fused or adhered to one another by melting, gluing, wrapping around, chemical or mechanical bonds, or otherwise joined together while at least partially retaining their respective individual fiber characteristics.

Figure 9:
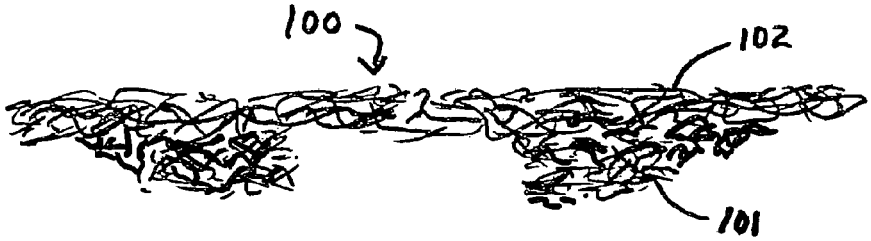
FIG. 9 is a cross-sectional view of a unitary fibrous structure of the present invention, wherein the cellulosic fibers are distributed generally randomly and the synthetic fibers are distributed generally non-randomly.
Figure 9A:
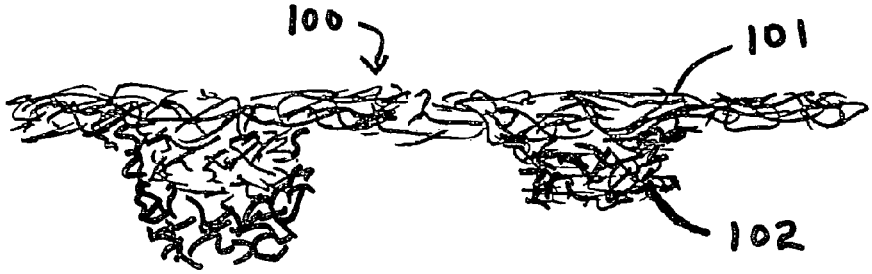
FIG. 9A is a cross-sectional view of a unitary fibrous structure of the present invention, wherein the synthetic fibers are distributed generally randomly and the cellulosic fibers are distributed generally non-randomly.

Generally, the process of the present invention for making a unitary fibrous structure will be described in terms of forming a web having a plurality of synthetic fibers disposed in a generally non-random pattern and a plurality of cellulosic fibers disposed generally randomly (e.g. as shown in FIG. 9). However, as noted above, the method and apparatus of the present invention are also suitable for forming a web having a plurality of cellulosic fibers disposed in a generally non-random pattern and a plurality of synthetic fibers disposed generally randomly (e.g. as shown in FIG. 9A) and for webs where the cellulosic fibers and the synthetic fibers are disposed in non-random patterns that are different from each other. In embodiments wherein the synthetic fibers are disposed non-randomly, the method may include the steps of: providing a plurality of synthetic fibers onto a forming member such that the synthetic fibers are located at least in predetermined regions or channels; providing a plurality of cellulosic fibers generally randomly on the forming member containing the synthetic fibers; and forming a unitary fibrous structure including the randomly disposed cellulosic fibers and the non-randomly disposed synthetic fibers.

Figure 7:
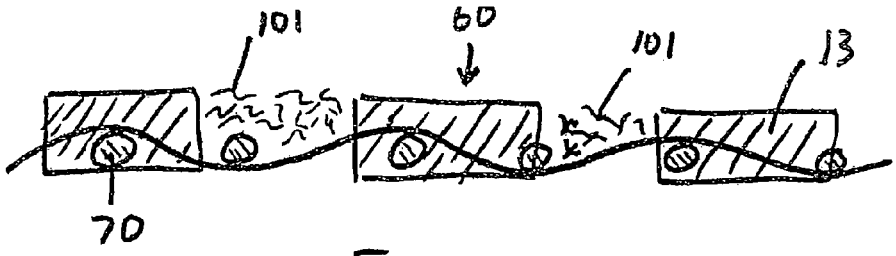
FIG. 7 is a schematic cross-sectional view showing exemplary synthetic fibers distributed in the channels formed in the forming member.
Figure 8:
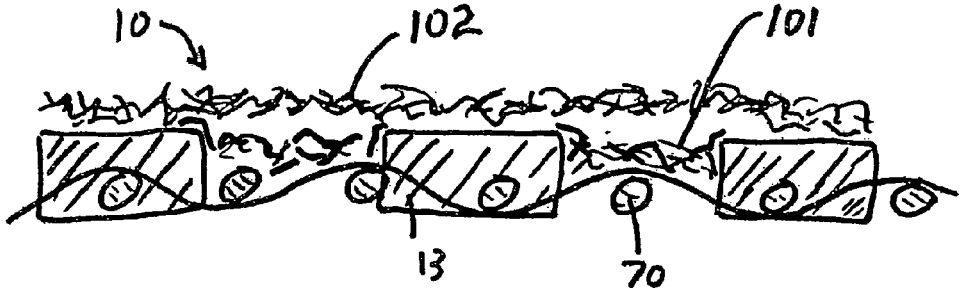
FIG. 8 is a cross-sectional view showing a unitary fibrous structure of the present invention, wherein the cellulosic fibers are randomly distributed on the forming member including the synthetic fibers.

FIG. 1 shows one exemplary embodiment of a continuous process of the present invention in which an aqueous mixture, or aqueous slurry 11 of cellulosic and synthetic fibers, from a headbox 12 is deposited on a forming member 13 to form an embryonic web 10. In this particular embodiment, the forming member 13 is supported by and continuously traveling around rolls 13*a*, 13*b*, and 13*c* in a direction of the arrow A. The synthetic fibers 101 may be deposited prior to the deposition of the cellulosic fibers 102 and directly onto the forming member 13. In certain embodiments, more than one headbox 12 can be employed and/or the synthetic fibers 101 may be deposited onto a forming member 13 and then transferred to a different forming member where the cellulosic fibers 102 are then deposited. Alternatively, the synthetic fibers 101 could be one of several layers that are deposited onto the forming member 13 at about the same time as other types of fibers, such as, for example using a multi-layer headbox. In such embodiments, the synthetic fibers 101 may be disposed adjacent the forming member 13 and the cellulosic fibers 102 may be provided onto at least some of the synthetic fibers 101. In any case, the synthetic fibers 101 should be deposited in such a way that at least some of the synthetic fibers 101 are directed into predetermined regions, such as channels 53 present in forming member 13 (e.g. as shown in FIGS. 7-8).

In one embodiment of the present invention, the synthetic fibers 101 are provided so as to be predominantly disposed in the channels 53 of the forming member 13. That is, more than half of the synthetic fibers 101 are disposed in the channels 53 when the web 10 is being formed. In certain embodiments, it may be desirable for at least about 60%, about 75%, about 80% or substantially all of the synthetic fibers 101 to be disposed in the channels 53 when the web 10 is being formed. In addition, it may be desired that the resulting product, web 100, includes a certain percentage of synthetic fibers 101 disposed in one or more layers. For example, it may be desirable that the layer formed by fibers deposited first or closest to the forming member 13 have a concentration of greater than about 50%, greater than about 60% or greater than about 75% synthetic fibers 101. (A suitable method for measuring the percentage of a particular type of fiber in a layer of a web product is disclosed in U.S. Pat. No. 5,178,729 issued to Bruce Janda on Jan. 12, 1993.) Further, in certain embodiments, it may be desired that the cellulosic fibers 102 be provided so as to be disposed predominantly in at least one layer adjacent the layer including the non-randomly disposed synthetic fibers 101. In other embodiments, it may be desired that at least a certain percentage of the cellulosic fibers 102 are disposed in at least one layer of the web 100, such as for example, greater than about 55%, greater than about 60% or greater than about 75%. Typically, at least one layer of the cellulosic fibers 102 will be disposed generally randomly. Thus, the resulting web 100 can be provided with a non-random pattern of synthetic fibers 101 joined to one or more layers of generally randomly distributed cellulosic fibers 102 (e.g. FIGS. 9 and 10). Further, a fibrous structure can be formed that has micro-regions of different basis weight.

Figure 2:
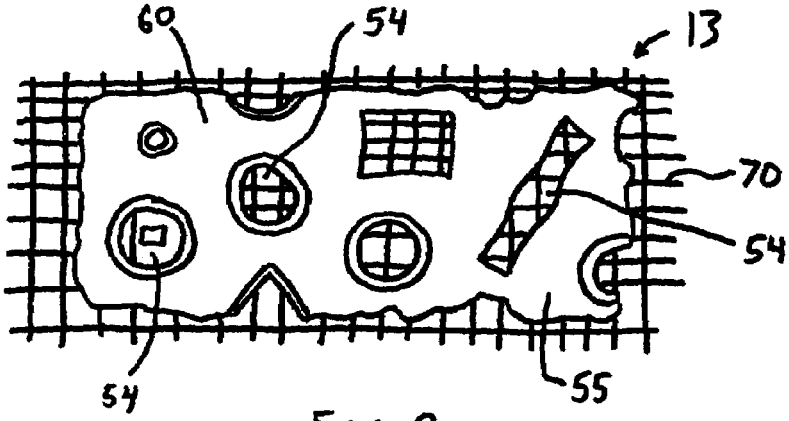
FIG. 2 is a schematic plan view of an embodiment of a forming member having a substantially continuous framework.
Figure 3:
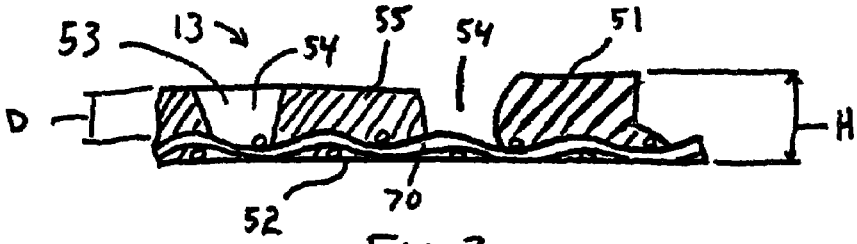
FIG. 3 is a representational cross-sectional view of an exemplary forming member.
Figure 4:
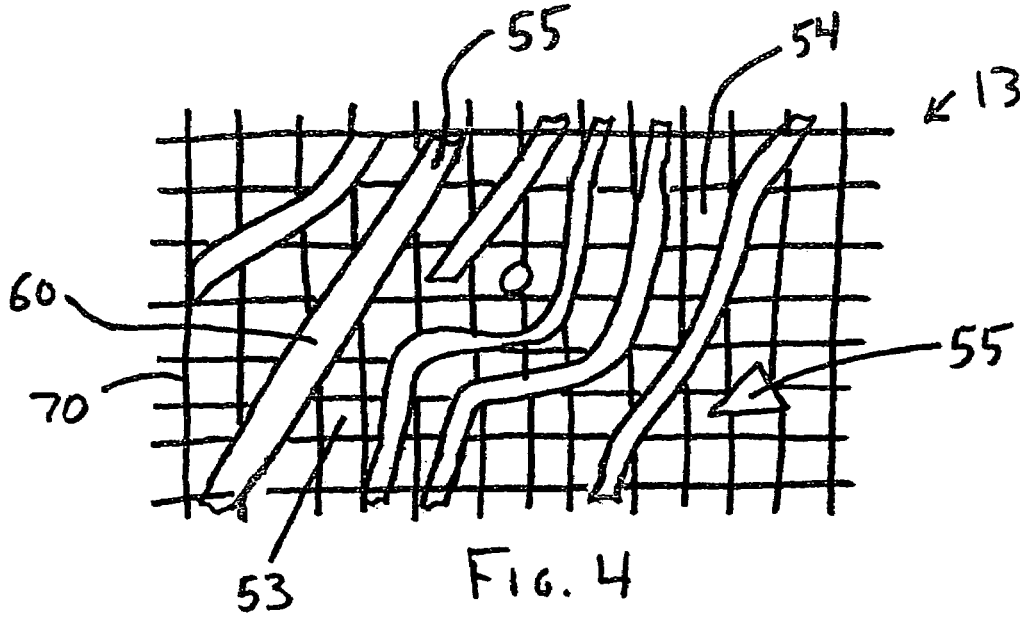
FIG. 4 is a schematic plan view of an embodiment of a forming member having a substantially semi-continuous framework.

The forming member 13 may be any suitable structure and is typically at least partially fluid-permeable. For example, the forming member 13 may comprise a plurality of fluid-permeable areas 54 and a plurality of fluid-impermeable areas 55, as shown, for example in FIGS. 2-6. The fluid-permeable areas or apertures 54 may extend through a thickness H of the forming member 13, from the web-side 51 to the backside 52. In certain embodiments, some of the fluid-permeable areas 54 comprising apertures may be "blind," or "closed", as described in U.S. Pat. No. 5,972,813, issued to Polat et al. on Oct. 26, 1999. The fluid permeable areas 54, whether open, blind or closed form channels 53 into which fibers can be directed. At least one of the plurality of fluid-permeable areas 54 and the plurality of fluid-impermeable areas 55 typically forms a pattern throughout the molding member 50. Such a pattern can comprise a random pattern or a non-random pattern and can be substantially continuous (e.g. FIG. 2), substantially semi-continuous (e.g. FIG. 4), discrete (e.g. FIG. 5) or any combination thereof.

The forming member 13 may have any suitable thickness H and, in fact, the thickness H can be made to vary throughout the forming member 13, as desired. Further, the channels 53 may be any shape or combination of different shapes and may have any depth D, which can vary throughout the forming member 13. Also, the channels 53 can have any desired volume. The depth D and volume of the channels 53 can be varied, as desired, to help ensure the desired concentration of synthetic fibers 101 in the channels 53. In certain embodiments, it may be desirable for the depth D of the channels 53 to be less than about 254 micrometers or less than about 127 micrometers. Further, the amount of synthetic fibers 101 deposited onto the forming member 13 can be varied so as to ensure the desired ratio or percentage of synthetic fibers 101 and/or cellulosic fibers 102 are disposed in the channels 53 of a particular depth D or volume. For example, in certain embodiments, it may be desirable to provide enough synthetic fibers 101 to substantially fill channels 53 such that virtually no cellulosic fibers 102 will be located in the channels 53 during the web making process, while in other embodiments, it may be desirable to provide only enough synthetic fibers 101 to fill a portion of the channels 53 such that at least some cellulosic fibers 102 can also be directed into the channels 53.

Figure 5:
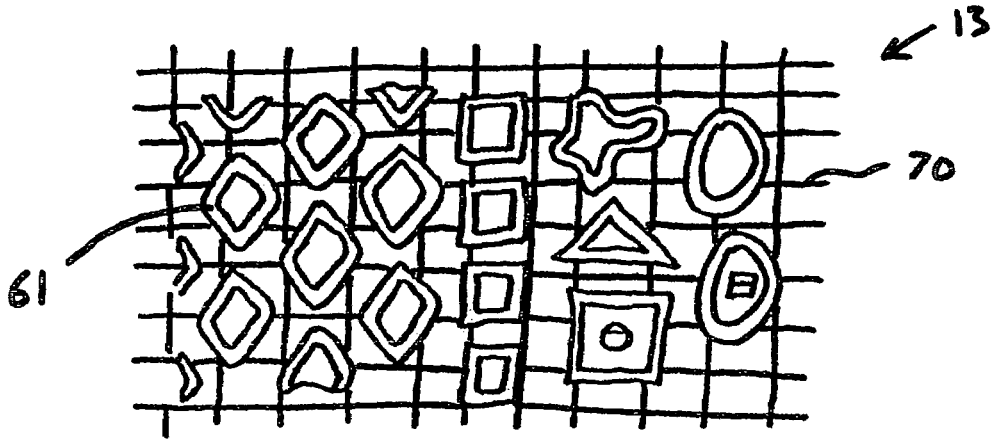
FIG. 5 is a schematic plan view of an embodiment of a forming member having a discrete pattern framework.
Figure 6:
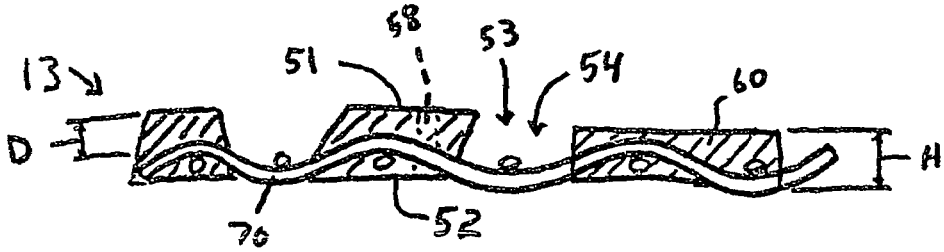
FIG. 6 is a representational cross-sectional view of an exemplary forming member.

Some exemplary forming members 13 may comprise structures as shown in FIGS. 2-8 including a fluid-permeable reinforcing element 70 and a pattern or framework 60 extending there from to form a plurality of channels 53. In one embodiment, as shown in FIGS. 5 and 6, the forming member 13 may comprise a plurality of discrete protuberances 61 joined to or integral with a reinforcing element 70. The reinforcing element 70 generally serves to provide or facilitate integrity, stability, and durability. The reinforcing element 70 can be fluid-permeable or partially fluid-permeable, may have a variety of embodiments and weave patterns, and may comprise a variety of materials, such as, for example, a plurality of interwoven yarns (including Jacquard-type and the like woven patterns), a felt, a plastic or other synthetic material, a net, a plate having a plurality of holes, or any combination thereof. Examples of suitable reinforcing elements 70 are described in U.S. Pat. No. 5,496,624, issued Mar. 5, 1996 to Stelljes, et al., U.S. Pat. No. 5,500,277 issued Mar. 19, 1996 to Trokhan et al., and U.S. Pat. No. 5,566,724 issued Oct. 22, 1996 to Trokhan et al. Alternatively, a reinforcing element 70 comprising a Jacquard-type weave, or the like, can be utilized. Illustrative belts can be found in U.S. Pat. No. 5,429,686 issued Jul. 4, 1995 to Chiu, et al.; U.S. Pat. No. 5,672,248 issued Sep. 30, 1997 to Wendt, et al.; U.S. Pat. No. 5,746,887 issued May 5, 1998 to Wendt, et al.; and U.S. Pat. No. 6,017,417 issued Jan. 25, 2000 to Wendt, et al. Further, various designs of the Jacquard-weave pattern may be utilized as a forming member 13.

Exemplary suitable framework elements 60 and methods for applying the framework 60 to the reinforcing element 70, are taught, for example, by U.S. Pat. No. 4,514,345 issued Apr. 30, 1985 to Johnson; U.S. Pat. No. 4,528,239 issued Jul. 9, 1985 to Trokhan; U.S. Pat. No. 4,529,480 issued Jul. 16, 1985 to Trokhan; U.S. Pat. No. 4,637,859 issued Jan. 20, 1987 to Trokhan; U.S. Pat. No. 5,334,289 issued Aug. 2, 1994 to Trokhan; U.S. Pat. No. 5,500,277 issued Mar. 19, 1996 to Trokhan et al.; U.S. Pat. No. 5,514,523 issued May 7, 1996 to Trokhan et al.; U.S. Pat. No. 5,628,876 issued May 13, 1997 to Ayers et al.; U.S. Pat. No. 5,804,036 issued Sep. 8, 1998 to Phan et al.; U.S. Pat. No. 5,906,710 issued May 25, 1999 to Trokhan; U.S. Pat. No. 6,039,839 issued Mar. 21, 2000 to Trokhan et al.; U.S. Pat. No. 6,110,324 issued Aug. 29, 2000 to Trokhan et al.; U.S. Pat. No. 6,117,270 issued Sep. 12, 2000 to Trokhan; U.S. Pat. No. 6,171,447 B1 issued Jan. 9, 2001 to Trokhan; and U.S. Pat. No. 6,193,847 B1 issued Feb. 27, 2001 to Trokhan. Further, as shown in FIG. 6, framework 60 may include one or apertures or holes 58 extending through the framework element 60. Such holes 58 are different from the channels 53 and may be used to help dewater the slurry or web and/or aid in keeping fibers deposited on the framework 60 from moving completely into the channels 53.

Alternatively, the forming member 13 may include any other structure suitable for receiving fibers and including some pattern of channels 53 into which the synthetic fibers 101 may be directed, including, but not limited to, wires, composite belts and/or felts. In any case, the pattern may be discrete, as noted above, or substantially discrete, may be continuous or substantially continuous or may be semi-continuous or substantially semi-continuous. Certain exemplary forming members 13 generally suitable for use with the method of the present invention include the forming members described in U.S. Pat. Nos. 5,245,025; 5,277,761; 5,443,691; 5,503,715; 5,527,428; 5,534,326; 5,614,061 and 5,654,076.

If the forming member 13 includes a press felt, it may be made according to the teachings of U.S. Pat. No. 5,580,423, issued Dec. 3, 1996 to Ampulski et al.; U.S. Pat. No. 5,609,725, issued Mar. 11, 1997 to Phan; U.S. Pat. No. 5,629,052 issued May 13, 1997 to Trokhan et al.; U.S. Pat. No. 5,637,194, issued Jun. 10, 1997 to Ampulski et al.; U.S. Pat. No. 5,674,663, issued Oct. 7, 1997 to McFarland et al.; U.S. Pat. No. 5,693,187 issued Dec. 2, 1997 to Ampulski et al.; U.S. Pat. No. 5,709,775 issued Jan. 20, 1998 to Trokhan et al.; U.S. Pat. No. 5,776,307 issued Jul. 7, 1998 to Ampulski et al.; U.S. Pat. No. 5,795,440 issued Aug. 18, 1998 to Ampulski et al.; U.S. Pat. No. 5,814,190 issued Sep. 29, 1998 to Phan; U.S. Pat. No. 5,817,377 issued Oct. 6, 1998 to Trokhan et al.; U.S. Pat. No. 5,846,379 issued Dec. 8, 1998 to Ampulski et al.; U.S. Pat. No. 5,855,739 issued Jan. 5, 1999 to Ampulski et al.; and U.S. Pat. No. 5,861,082 issued Jan. 19, 1999 to Ampulski et al. In an alternative embodiment, the forming member 13 may be executed as a press felt according to the teachings of U.S. Pat. No. 5,569,358 issued Oct. 29, 1996 to Cameron or any other suitable structure. Other structures suitable for use as forming members 13 are hereinafter described with respect to the optional molding member 50.

A vacuum apparatus such as vacuum apparatus 14 located under the forming member 13 may be used to apply fluid pressure differential to the slurry disposed on the forming member 13 to facilitate at least partial dewatering of the embryonic web 10. This fluid pressure differential can also help direct the desired fibers, e.g. the synthetic fibers 101 into the channels 53 of the forming member 13. Other known methods may be used in addition to or as an alternative to the vacuum apparatus 14 to dewater the web 10 and/or to help direct the fibers into the channels 53 of the forming member 13.

If desired, the embryonic web 10, formed on the forming member 13, can be transferred from the forming member 13, to a felt or other structure such as a molding member. A molding member is a structural element that can be used as a support for the an embryonic web, as well as a forming unit to form, or "mold," a desired microscopical geometry of the fibrous structure. The molding member may comprise any element that has the ability to impart a microscopical three-dimensional pattern to the structure being produced thereon, and includes, without limitation, single-layer and multi-layer structures comprising a stationary plate, a belt, a woven fabric (including Jacquard-type and the like woven patterns), a band, and a roll.

In the exemplary embodiment shown in FIG. 1, the molding member 50 is fluid permeable and vacuum shoe 15 applies vacuum pressure that is sufficient to cause the embryonic web 10 disposed on the forming member 13 to separate there from and adhere to the molding member 50. The molding member 50 of FIG. 1 comprises a belt supported by and traveling around rolls 50*a*, 50*b*, 50*c*, and 50*d* in the direction of the arrow B. The molding member 50 has a web-contacting side 151 and a backside 152 opposite to the web-contacting side 151.

The molding member 50 can take on any suitable form and can be made of any suitable materials. The molding member 50 may include any structure and be made by any of the methods described herein with respect to the forming member 13, although the molding member 50 is not limited to such structures or methods. For example, the molding member 50 comprises a resinous framework 160 joined to a reinforcing element 170, as shown, for example in FIGS. 13-14. Further, various designs of Jacquard-weave patterns may be utilized as the molding member 50, and/or a pressing surface 210. If desired, the molding member 50 may be or include a press felt. Suitable press felts for use with the present invention include, but are not limited to those described herein with respect to the forming member 13

Figure 13:
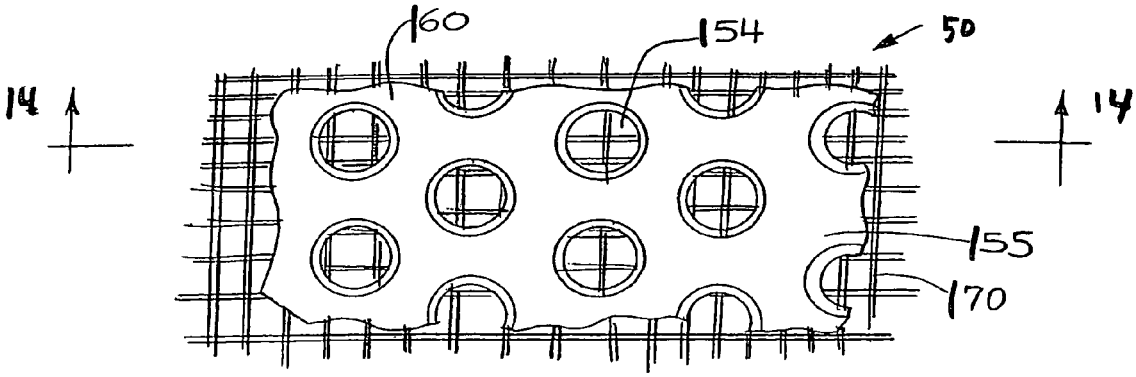
FIG. 13 is a schematic plan view of an embodiment of a molding member having a substantially continuous pattern framework.
Figure 14:
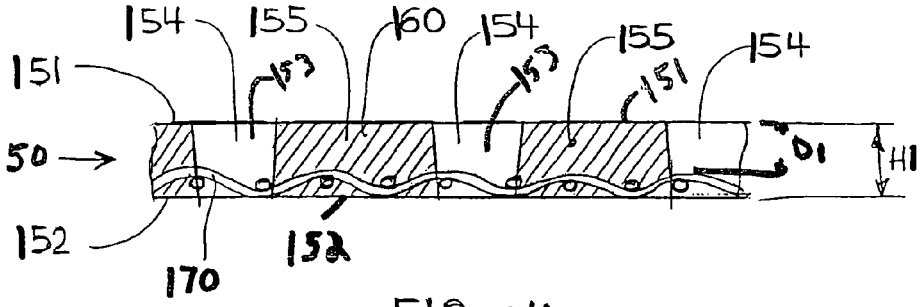
FIG. 14 is a schematic cross-sectional view taken along line 14-14 of FIG. 13.

In certain embodiments, the molding member 50 may comprise a plurality of fluid-permeable areas 154 and a plurality of fluid-impermeable areas 155, as shown, for example in FIGS. 13 and 14. The fluid-permeable areas or apertures 154 extend through a thickness H1 of the molding member 50, from the web-side 151 to the backside 152. As noted above with respect to the forming member 13, the thickness H1 of the molding member can be any desired thickness. Further, the depth D1 and volume of the channels 153 can vary, as desired. Further, one or more of the fluid-permeable areas 154 comprising apertures may be "blind," or "closed", as described above with respect to the forming member 13. At least one of the plurality of fluid-permeable areas 154 and the plurality of fluid-impermeable areas 155 typically forms a pattern throughout the molding member 50. Such a pattern can comprise a random pattern or a non-random pattern and can be substantially continuous, substantially semi-continuous, discrete or any combination thereof. The portions of the reinforcing element 170 registered with apertures 154 in the molding member 50 may provide support for fibers that are deflected into the fluid-permeable areas of the molding member 50 during the process of making the unitary fibrous structure 100. The reinforcing element can help prevent the fibers of the web being made from passing through the molding member 50, thereby reducing occurrences of pinholes in the resulting structure 100.

In certain embodiments, the molding member 50 may comprise a plurality of suspended portions extending from a plurality of base portions, as is taught by U.S. Pat. No. 6,576,090 issued Jun. 10, 2003 to Trokhan et al. In such embodiments, the suspended portions may be elevated from the reinforcing element 170 to form void spaces between the suspended portions and the reinforcing element 170, into which spaces the fibers of the embryonic web 10 can be deflected to form cantilever portions of the fibrous structure 100. The molding member 50 having suspended portions may comprise a multi-layer structure formed by at least two layers and joined together in a face-to-face relationship. The joined layers may be positioned such that the apertures of one layer are superimposed (in the direction perpendicular to the general plane of the molding member 50) with a portion of the framework of the other layer, which portion forms the suspended portion described above. Another embodiment of the molding member 50 comprising a plurality of suspended portions can be made by a process involving differential curing of a layer of a photosensitive resin, or other curable material, through a mask comprising transparent regions and opaque regions. The opaque regions comprise regions having differential opacity, for example, regions having a relatively high opacity (non-transparent) and regions having a relatively low, partial, opacity (some transparency).

When the embryonic web 10 is disposed on the web-contacting side 151 of the molding member 50, the web 10 at least partially conforms to the three-dimensional pattern of the molding member 50. In addition, various means can be utilized to cause or encourage the cellulosic and/or synthetic fibers of the embryonic web 10 to conform to the three-dimensional pattern of the molding member 50 and to become a molded web designated as "20" in FIG. 1. (It is to be understood, that the referral numerals "10" and "20" can be used herein interchangeably, as well as the terms "embryonic web" and "molded web"). One method includes applying a fluid pressure differential to the plurality of fibers. For example, as shown in FIG. 1, vacuum apparatuses 16 and/or 17 disposed at the backside 152 of the molding member 50 can be arranged to apply a vacuum pressure to the molding member 50 and thus to the plurality of fibers disposed thereon. Under the influence of fluid pressure differential $\Delta P1$ and/or $\Delta P2$ created by the vacuum pressure of the vacuum apparatuses 16 and 17, respectively, portions of the embryonic web 10 can be deflected into the channels 153 of the molding member 50 and conform to the three-dimensional pattern thereof.

Figure 11:
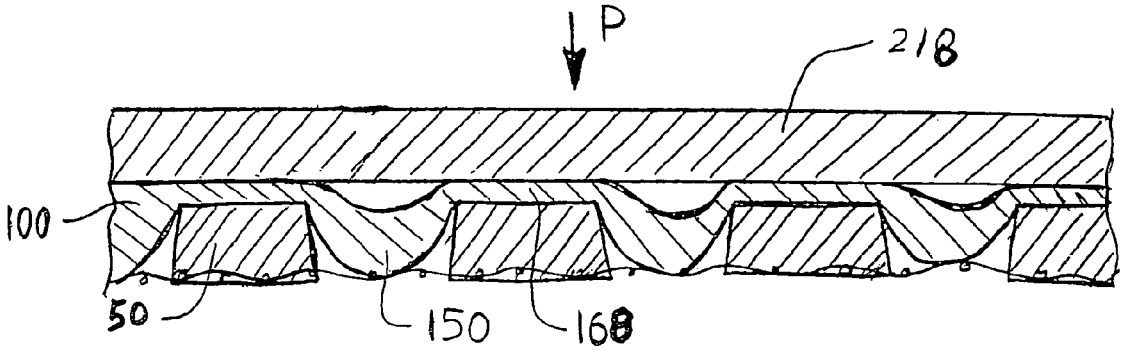
FIG. 11 is a schematic cross-sectional view of a unitary fibrous structure of the present invention between a pressing surface and a molding member.

By deflecting portions of the web 10 into the channels 153 of the molding member 50, one can decrease the density of resulting pillows 150 formed in the channels 153 of the molding member 50, relative to the density of the rest of the molded web 20. Regions 168 that are not deflected into the apertures may later be imprinted by impressing the web 20 between a pressing surface 218 and the molding member 50 (FIG. 11), such as, for example, in a compression nip formed between a surface 210 of a drying drum 200 and the roll 50*c*, shown in FIG. 1. If imprinted, the density of the regions 168 may increase even more relative to the density of the pillows 150.

The micro-regions (high and low density) of the fibrous structure 100 may be thought of as being disposed at two different elevations. As used herein, the elevation of a region refers to its distance from a reference plane (i.e., X-Y plane). The reference plane can be visualized as horizontal, wherein the elevational distance from the reference plane is vertical (i.e., Z-directional). The elevation of a particular micro-region of the structure 100 may be measured using any non-contacting measurement device suitable for such purpose as is well known in the art. The fibrous structure 100 according to the present invention can be placed on the reference plane with the imprinted region 168 in contact with the reference plane. The pillows 150 extend vertically away from the reference plane. The plurality of pillows 150 may comprise symmetrical pillows, asymmetrical pillows, or a combination thereof.

Differential elevations of the micro-regions can also be formed by using the molding member 50 having differential depths or elevations of its three-dimensional pattern. Such three-dimensional patterns having differential depths/elevations can be made by sanding pre-selected portions of the molding member 50 to reduce their elevation. Alternatively, a three-dimensional mask comprising differential depths/elevations of its depressions/protrusions, can be used to form a corresponding framework 160 having differential elevations. Other conventional techniques of forming surfaces with differential elevation can also be used for the foregoing purposes. It should be recognized that the techniques described herein for forming the molding member are also applicable to the formation of the forming member 13.

To ameliorate possible negative effects of a sudden application of a fluid pressure differential to the fibrous structure made by a vacuum apparatuses 16 and/or 17 and/or a vacuum pick-up shoe 15 that could force some of the filaments or portions thereof all the way through the molding member 50 and thus lead to forming so-called pin-holes in the resultant fibrous structure, the backside 152 of the molding member 50 can be "textured" to form microscopical surface irregularities. Such surface irregularities can help prevent formation of a vacuum seal between the backside 52 of the molding member 50 and a surface of the papermaking equipment (such as, for example, a surface of the vacuum apparatus), creating "leakage" there between and thus, mitigating certain undesirable consequences of an application of a vacuum pressure in a through-air-drying process. Other methods of creating such leakage are disclosed in U.S. Pat. Nos. 5,718,806; 5,741,402; 5,744,007; 5,776,311 and 5,885,421.

Leakage can also be created using so-called "differential light transmission techniques" as described in U.S. Pat. Nos. 5,624,790; 5,554,467; 5,529,664; 5,514,523 and 5,334,289. The molding member 50 can be made by applying a coating of photosensitive resin to a reinforcing element that has opaque portions, and then exposing the coating to light of an activating wavelength through a mask having transparent and opaque regions, and also through the reinforcing element. Another way of creating backside surface irregularities comprises the use of a textured forming surface, or a textured barrier film, as described in U.S. Pat. Nos. 5,364,504; 5,260,171 and 5,098,522. The molding member 50 may be made by casting a photosensitive resin over and through the reinforcing element while the reinforcing element travels over a textured surface, and then exposing the coating to light of an activating wavelength through a mask, which has transparent and opaque regions. It should be understood that the methods and structures described in this paragraph and the preceding paragraph may also be applicable to the structure and formation of the forming member 13.

The process of the present invention may also include a step wherein the embryonic web 10 (or molded web 20) is overlaid with a flexible sheet of material comprising an endless band traveling along with the molding member 50 so that the embryonic web 10 is sandwiched, for a certain period of time, between the molding member 50 and the flexible sheet of material. The flexible sheet of material can have air-permeability less than that of the molding member 50, and in some embodiments can be air-impermeable. An application of a fluid pressure differential to the flexible sheet through the molding member 50 can cause deflection of at least a portion of the flexible sheet towards, and in some instances into, the three-dimensional pattern of the molding member 50, thereby forcing portions of the web 20 disposed on the molding member 50 to closely conform to the three-dimensional pattern of the molding member 50. U.S. Pat. No. 5,893,965 describes one arrangement of a process and equipment utilizing the flexible sheet of material.

Additionally or alternatively to the fluid pressure differential, mechanical pressure can be used to facilitate formation of a microscopical three-dimensional pattern on the fibrous structure 100 of the present invention. Such a mechanical pressure can be created by any suitable press surface 218, comprising, for example a surface of a roll or a surface of a band. The press surface 218 can be smooth or have a three-dimensional pattern of its own. In the latter instance, the press surface 218 can be used as an embossing device, to form a distinctive micro-pattern of protrusions and/or depressions in the fibrous structure 100 being made, in cooperation with or independently from the three-dimensional pattern of the molding member 50. Furthermore, the press surface can be used to deposit a variety of additives, such for example, as softeners, and ink, to the fibrous structure being made. Various other conventional techniques, such as, for example, ink roll, or spraying device, or shower, may be used to directly or indirectly deposit a variety of additives to the fibrous structure being made.

In certain embodiments, it may be desirable to foreshorten the fibrous structure 100 of the present invention as it is being formed. For example, the molding member 50 may be configured to have a linear velocity that is less that that of the forming member 13. The use of such a velocity differential at the transfer point from the forming member 13 to the molding member 50 can be used to achieve "microcontraction". U.S. Pat. No. 4,440,597 describes in detail one example of wet-microcontraction. Such wet-microcontraction may involve transferring the web having a low fiber-consistency from any first member (such as, for example, a foraminous forming member) to any second member (such as, for example, an open-weave fabric) moving slower than the first member. The difference in velocity between the first member and the second member can vary depending on the desired end characteristics of the fibrous structure 100. Other patents that describe methods for achieving microcontraction include, for example, U.S. Pat. Nos. 5,830,321; 6,361,654 and 6,171,442.

The fibrous structure 100 may additionally or alternatively be foreshortened after it has been formed and/or substantially dried. For example, foreshortening can be accomplished by creping the structure 100 from a rigid surface, such as, for example, a surface 210 of a drying drum 200, as shown in FIG. 1. This and other forms of creping are known in the art. U.S. Pat. No. 4,919,756, issued Apr. 24, 1992 to Sawdai describes one suitable method for creping a web. Of course, fibrous structures 100 that are not creped (e.g. uncreped) and/or otherwise foreshortened are contemplated to be within the scope of the present invention as are fibrous structures 100 that are not creped, but are otherwise foreshortened.

Figure 12:
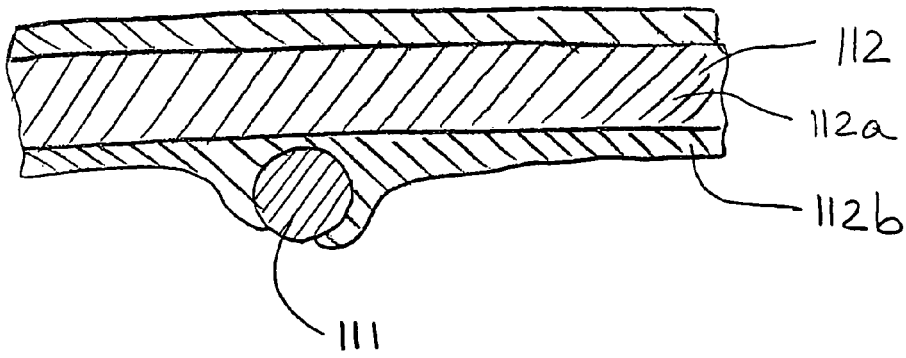
FIG. 12 is a schematic cross-sectional view of a bi-component synthetic fiber co-joined with another fiber.

In certain embodiments, it may be desirable to at least partially melt or soften at least some of the synthetic fibers 101. As the synthetic fibers at least partially melt or soften, they may become capable of co-joining with adjacent fibers, whether cellulosic fibers 102 or other synthetic fibers 101. Co-joining of fibers can comprise mechanical co-joining and chemical co-joining. Chemical co-joining occurs when at least two adjacent fibers join together on a molecular level such that the identity of the individual co-joined fibers is substantially lost in the co-joined area. Mechanical co-joining of fibers takes place when one fiber merely conforms to the shape of the adjacent fiber, and there is no chemical reaction between the co-joined fibers. FIG. 12 shows one embodiment of mechanical co-joining, wherein a fiber 111 is physically entrapped by an adjacent synthetic fiber 112. The fiber 111 can be a synthetic fiber or a cellulosic fiber. In the example shown in FIG. 12, the synthetic fiber 112 has a bi-component structure, comprising a core 112*a* and a sheath, or shell, 112*b*, wherein the melting temperature of the core 112*a* is greater than the melting temperature of the sheath 112*b*, so that when heated, only the sheath 112*b* melts, while the core 112*a* retains its integrity. However, it is to be understood that different types of bi-component fibers and/or multi-component fibers comprising more than two components can be used in the present invention, as can single component fibers.

In certain embodiments, it may be desirable to redistribute at least some of the synthetic fibers in the web 100 after the web 100 is formed. Such redistribution can occur while the web 100 is disposed on the molding member 50 or at a different time and/or location in the process. For example, a heating apparatus 90, the drying surface 210 and/or a drying drum's hood (such as, for example, a Yankee's drying hood 80) can be used to heat the web 100 after it is formed to redistribute at least some of the synthetic fibers 101. Without wishing to be bound by theory, it is believed that the synthetic fibers 101 can move after application of a sufficiently high temperature, under the influence of at least one of two phenomena. If the temperature is sufficiently high to melt the synthetic fiber 101, the resulting liquid polymer will tend to minimize its surface area/mass, due to surface tension forces, and form a sphere-like shape at the end of the portion of fiber that is less affected thermally. On the other hand, if the temperature is below the melting point, fibers with high residual stresses will soften to the point where the stress is relieved by shrinking or coiling of the fiber. This is believed to occur because polymer molecules typically prefer to be in a non-linear coiled state. Fibers that have been highly drawn and then cooled during their manufacture are comprised of polymer molecules that have been stretched into a meta-stable configuration. Upon subsequent heating, the fibers attempt to return to the minimum free energy coiled state.

Redistribution may be accomplished in any number of steps. For example, the synthetic fibers 101 can first be redistributed while the fibrous web 100 is disposed on the molding member 50, for example, by blowing hot gas through the pillows of the web 100, so that the synthetic fibers 101 are redistributed according to a first pattern. Then, the web 100 can be transferred to another molding member 50 wherein the synthetic fibers 101 can be further redistributed according to a second pattern.

Heating the synthetic fibers 101 in the web 100 can be accomplished by heating the plurality of micro-regions corresponding to the fluid-permeable areas 154 of the molding member 50. For example, a hot gas from the heating apparatus 90 can be forced through the web 100. Pre-dryers can also be used as the source of heat energy. In any case, it is to be understood that depending on the process, the direction of the flow of hot gas can be reversed relative to that shown in FIG. 1, so that the hot gas penetrates the web through the molding member 50. Then, the pillow portions 150 of the web that are disposed in the fluid-permeable areas 154 of the molding member 50 will be primarily affected by the hot gas. The rest of the web 100 will be shielded from the hot gas by the molding member 50. Consequently, the synthetic fibers 101 will be softened or melted predominantly in the pillow portions 150 of the web 10. Further, this region is where co-joining of the fibers due to melting or softening of the synthetic fibers 101 is most likely to occur.

Although the redistribution of the synthetic fibers 101 has been described above as having been affected by passage of hot gas over at least a portion of some of the fibers 101, any suitable means for heating the fibers 101 can be implemented. For example, hot fluids may be used, as well as microwaves, radio waves, ultrasonic energy, laser or other light energy, heated belts or rolls, hot pins, magnetic energy, or any combination of these or other known means for heating. Further, although redistribution of the synthetic fibers 101 has generally been referred to as having been affected by heating the fibers 101, redistribution may also take place as a result of cooling a portion of the web 10. As with heating, cooling of the synthetic fibers 101 may cause the fibers 101 to change shape and/or reorient themselves with respect to the rest of the web. Further yet, the synthetic fibers may be redistributed due to a reaction with a redistribution material. For example, the synthetic fibers 101 may be targeted with a chemical composition that softens or otherwise manipulates the synthetic fibers 101 so as to affect some change in their shape, orientation or location within the web 10. Further yet, the redistribution can be affected by mechanical and/or other means such as magnetics, static electricity, etc. Accordingly, redistribution of the synthetic fibers 101, as described herein, should not be considered to be limited to just heat redistribution of the synthetic fibers 101, but should be considered to encompass all known means for redistributing (e.g. altering the shape, orientation or location) of any portion of the synthetic fibers 101 within the web 10.

Figure 10:
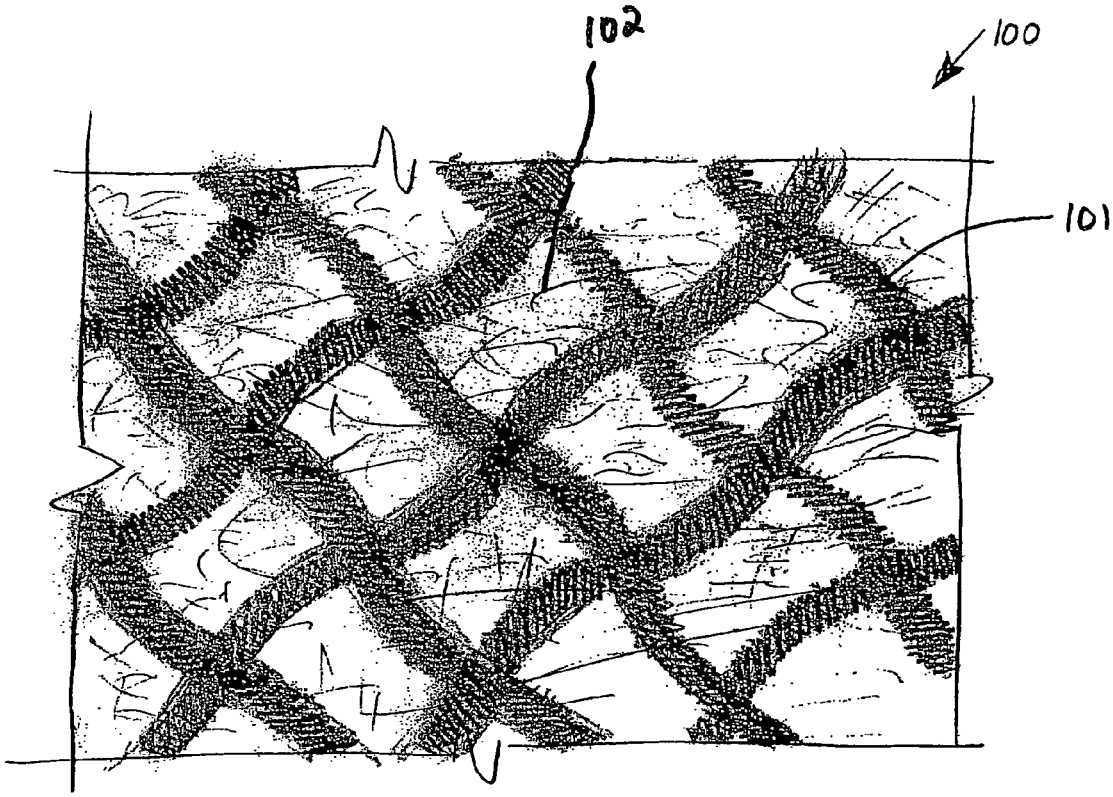
FIG. 10 is a schematic plan view of an embodiment of the unitary fibrous structure of the present invention.

While the synthetic fibers 101 may be redistributed in a manner and by means described herein, the process for producing the web can be selected such that the random distribution of the cellulosic fibers 102 is not significantly affected by the means used to redistribute the synthetic fibers 101. Thus, the resulting fibrous structure 100 whether redistributed or not comprises a plurality of cellulosic fibers 102 randomly distributed throughout the fibrous structure and a plurality of synthetic fibers 101 distributed throughout the fibrous structure in a non-random pattern. FIG. 10 schematically shows one embodiment of the fibrous structure 100 wherein the cellulosic fibers 102 are randomly distributed throughout the structure, and the synthetic fibers 101 are distributed in a non-random repeating pattern.

In one example, the method for making the unitary fibrous structure of the present invention comprises a step of redistributing at least some of the synthetic fibers to form a unitary fibrous structure in which at least some of the plurality of synthetic fibers are distributed in a pattern different from the pattern formed by the pattern of channels.

The synthetic fibers 101 can be any material, for example, those selected from the group consisting of polyolefins, polyesters, polyamides, polyhydroxyalkanoates, polysaccharides, and any combination thereof. More specifically, the material of the synthetic fibers 101 can be selected from the group consisting of polypropylene, polyethylene, poly(ethylene terephthalate), poly(butylene terephthalate), poly(1,4-cyclohexylenedimethylene terephthalate), isophthalic acid copolymers, ethylene glycol copolymers, polycaprolactone, poly(hydroxy ether ester), poly(hydroxy ether amide), polyesteramide, poly(lactic acid), polyhydroxybutyrate, starch, cellulose, glycogen and any combination thereof. Further, the synthetic fibers 101 can be single component (i.e. single synthetic material or mixture makes up entire fiber), bi-component (i.e. fiber is divided into regions, the regions including two different synthetic materials or mixtures thereof) or multi-component fibers (i.e. fiber is divided into regions, the regions including two or more different synthetic materials or mixtures thereof) or any combination thereof. Also, any or all of the synthetic fibers 101 may be treated before, during or after the process of the present invention to change any desired property of the fibers. For example, in certain embodiments, it may be desirable to treat the synthetic fibers 101 before or during the papermaking process to make them more hydrophilic, more wettable, etc.

The method of making the web of the present invention may also include any other desired steps. For example, the method may include converting steps such as winding the web onto a roll, calendering the web, embossing the web, perforating the web, printing the web and/or joining the web to one or more other webs or materials to form multi-ply structures. Some exemplary patents describing embossing include U.S. Pat. Nos. 3,414,459; 3,556,907; 5,294,475 and 6,030,690. In addition, the method may include one or more steps to add or enhance the properties of the web such as adding softening, strengthening and/or other treatments to the surface of the product or as the web is being formed. Further, the web may be provided with latex, for example, as described in U.S. Pat. No. 3,879,257 or other materials or resins to provide beneficial properties to the web.

A variety of products can be made using the fibrous structure 100 of the present invention. For example, the resultant products may find use in filters for air, oil and water; vacuum cleaner filters; furnace filters; face masks; coffee filters, tea or coffee bags; thermal insulation materials and sound insulation materials; nonwovens for one-time use sanitary products such as diapers, feminine pads, and incontinence articles; textile fabrics for moisture absorption and softness of wear such as microfiber or breathable fabrics; an electrostatically charged, structured web for collecting and removing dust; reinforcements and webs for hard grades of paper, such as wrapping paper, writing paper, newsprint, corrugated paper board, and webs for tissue grades of paper such as toilet paper, paper towel, napkins and facial tissue; medical uses such as surgical drapes, wound dressing, bandages, and dermal patches. The fibrous structure 100 may also include odor absorbents, termite repellents, insecticides, rodenticides, and the like, for specific uses. The resultant product may absorb water and oil and may find use in oil or water spill clean-up, or controlled water retention and release for agricultural or horticultural applications.

Test Methods:

Caliper is measured according to the following procedure, without considering the micro-deviations from absolute planarity inherent to the multi-density tissues made according to the aforementioned incorporated patents.

The tissue paper is preconditioned at 71° to 75° F. and 48 to 52 percent relative humidity for at least two hours prior to the caliper measurement. If the caliper of toilet tissue or other rolled products is being measured, 15 to 20 sheets are first removed from the outside of the roll and discarded. If the caliper of facial tissue or other boxed products is being measured, the sample is taken from near the center of the package. The sample is selected and then conditioned for an additional 15 minutes.

Caliper is measured using a low load Thwing-Albert Progage micrometer, Model 89-2012, available from the Thwing-Albert Instrument Company of Philadelphia, Pa. The micrometer loads the sample with a pressure of 95 grams per square inch using a 2.0 inch diameter presser foot and a 2.5 inch diameter support anvil. The micrometer has a measurement capability range of 0 to 0.0400 inches. Decorated regions, perforations, edge effects, etc., of the tissue should be avoided if possible.

Basis weight is measured according to the following procedure.

The tissue sample is selected as described above, and conditioned at 71° to 75° F. and 48 to 52 percent humidity for a minimum of 2 hours. Twelve finished product sheets are carefully selected, which are clean, free of holes, tears, wrinkles, folds, and other defects. To be clear, finished product sheets should include the number of plies that the particular finished product to be tested has. Thus, one ply product sample sets will contain 12 one-ply sheets; two ply product sample sets will contain 12 two ply sheets; and so on. The sample sets are split into two stacks each containing 6 finished product sheets. A stack of six finished product sheets is placed on top of a cutting die. The die is square, having dimensions of 3.5 inches by 3.5 inches and may have soft polyurethane rubber within the square to ease removal of the sample from the die after cutting. The six finished product sheets are cut using the die, and a suitable pressure plate cutter, such as a Thwing-Albert Alfa Hydraulic Pressure Sample Cutter, Model 240-7A. The second set of six finished product sheets is cut in the same manner. The two stacks of cut finished product sheets are combined into a 12 finished product sheet stack and conditioned for at least 15 additional minutes at 71° to 75° F. and 48 to 52 percent humidity.

The stack of 12 finished product sheets cut as described above is then weighed on a calibrated analytical balance having a resolution of at least 0.0001 grams. The balance is maintained in the same room in which the samples were conditioned. A suitable balance is made by Sartorius Instrument Company, Model A200S.

The basis weight, in units of pounds per 3,000 square feet, is calculated according to the following equation:

$$\frac{(\text{Weight of 12 cut finished product sheets (grams)} \times 3000}{(453.6\ \text{grams/pound}) \times (12\ \text{plies}) \times (12.25\ \text{sq. in. per ply}/144\ \text{sq. in/sq. ft.})}$$

The basis weight in units of pounds per 3,000 square feet for this sample is simply calculated using the following conversion equation:

$$\text{Basis Weight (lb/3,000 ft}^2\text{)} = \text{Weight of 12 ply pad (g)} \times 6.48$$

The units of density used here are grams per cubic centimeter (g/cc). With these density units of g/cc, it may be convenient to also express the basis weight in units of grams per square centimeters. The following equation may be used to make this conversion:

$$\text{Basis Weight}(g/\text{cm2}) = \frac{\text{Weight of 12 ply pad } (g)}{948.4}$$

All documents cited in the Detailed Description of the Invention are, in relevant part, incorporated by reference herein; the citation of any document is not to be construed as an admission that it is prior art with respect to the present invention. To the extent that any meaning or definition of the term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for making a unitary fibrous structure, comprising the steps of:

providing a first aqueous slurry comprising a plurality of synthetic fibers;

providing a second aqueous slurry comprising a plurality of cellulosic fibers;

depositing the first and second aqueous slurries onto a fluid-permeable forming member having fluid-permeable areas and fluid-impermeable areas and having a pattern of channels;

partially dewatering the deposited first and second slurries to form a fibrous web comprising a plurality of cellulosic fibers randomly distributed throughout at least a portion of the fibrous web and a plurality of synthetic fibers non-randomly distributed in the channels;

applying a fluid pressure differential to the fibrous web disposed on the forming member, thereby molding the fibrous web according to the pattern of channels, wherein the fibrous web disposed on the forming member comprises a first plurality of micro-regions corresponding to a plurality of fluid-permeable areas of the forming member and a second plurality of micro-regions corresponding to a plurality of fluid-impermeable areas of the forming member; and redistributing at least some of the synthetic fibers to form a unitary fibrous structure in which at least some of the plurality of synthetic fibers are disposed in a predetermined pattern different from the pattern formed by the pattern of channels and the plurality of cellulosic fibers remain generally randomly distributed throughout at least a portion of the fibrous structure.

2. The method of claim 1 wherein the step of redistributing at least some of the synthetic fibers comprises the step of heating the fibrous web to a temperature sufficient to cause redistribution of at least some of the synthetic fibers in the fibrous web.

3. The method of claim 2 wherein the step of heating the fibrous web occurs when the fibrous web is disposed on the molding member and/or a drying surface.

4. The method of claim 1 wherein the plurality of synthetic fibers are provided onto the forming member before the plurality of cellulosic fibers are provided.

5. The method of claim 1 wherein at least some of the synthetic fibers are co-joined to at least some of the cellulosic fibers to form the unitary fibrous structure.

6. The method of claim 1 wherein heat is used to co-join at least some of the synthetic fibers to at least some of the cellulosic fibers.

7. The method of claim 1 wherein at least some of the synthetic fibers are co-joined with other synthetic fibers.

8. The method of claim 1 wherein more than half of the synthetic fibers are disposed in the channels during formation of the unitary fibrous structure.

9. The method of claim 1 wherein at least some of the plurality of cellulosic fibers are not disposed in the channels.

10. The method of claim 1 wherein the step of redistributing the synthetic fibers includes heating or cooling at least a portion of some of the synthetic fibers.

11. The method of claim 1 wherein the step of redistributing the synthetic fibers includes mechanically or chemically manipulating at least a portion of some of the synthetic fibers.

12. The method of claim 1, further comprising the steps of:

providing a molding member comprising a plurality of fluid-permeable areas and a plurality of fluid-impermeable areas;

disposing the unitary fibrous structure on the molding member; and heating the unitary fibrous structure to a temperature sufficient to cause the redistribution of at least some of the synthetic fibers in the unitary fibrous structure.

13. The method of claim 12, further including the step of impressing the plurality of synthetic and cellulosic fibers between the molding member and a pressing surface to densify portions of the unitary fibrous structure.

14. The method of claim 13, wherein the step of providing a molding member comprises providing a molding member including a patterned framework selected from the group consisting of a substantially continuous pattern, a substantially semi-continuous pattern, a discrete pattern, or any combination thereof.

15. The method of claim 1 wherein the forming member is moving at a first velocity and the method further includes the steps of:

providing a second member at a second velocity that is less than the first velocity; and transferring the embryonic web from the forming member to the second member so as to microcontract the embryonic web.

16. The method of claim 1 wherein the unitary fibrous structure is creped and/or embossed.

17. The method of claim 1 wherein the unitary fibrous structure is uncreped.

18. The method of claim 1 wherein the unitary fibrous structure is combined with a separate unitary structure to form a multi-ply web.

19. The method of claim 1 including the further step of providing a latex to at least a portion of at least one surface of the unitary fibrous structure.

* * * * *

UNITED STATES PATENT AND TRADEMARK OFFICE

CERTIFICATE OF CORRECTION

PATENT NO. : 7,645,359 B2
APPLICATION NO. : 11/324988
DATED : January 12, 2010
INVENTOR(S) : Lorenz et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 0 days.

Signed and Sealed this

Sixteenth Day of November, 2010

David J. Kappos

David J. Kappos
*Director of the United States Patent and Trademark Office*